US007634205B2

(12) United States Patent
Jen

(10) Patent No.: US 7,634,205 B2
(45) Date of Patent: Dec. 15, 2009

(54) SHEET FEEDER WITH ELECTROSTATIC DUST-COLLECTING FUNCTION

(75) Inventor: Tsai Chih Jen, Taitung (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 11/390,066

(22) Filed: Mar. 28, 2006

(65) Prior Publication Data

US 2006/0222426 A1 Oct. 5, 2006

(30) Foreign Application Priority Data

Mar. 30, 2005 (TW) ..... 94109929 A

(51) Int. Cl.
*G03G 21/00* (2006.01)
*G03G 15/00* (2006.01)

(52) U.S. Cl. ..... 399/34; 399/98; 399/123

(58) Field of Classification Search ..... 399/34, 399/71, 123, 149, 245, 326, 327, 354, 358, 399/3, 310, 390, 111; 96/86, 65, 280, 68, 96/97, 67, 69

See application file for complete search history.

(56) References Cited

U.S. PATENT DOCUMENTS 4,750,018 A * 6/1988 Gooray et al. ..... 399/390
4,956,677 A * 9/1990 Akiyama ..... 399/129
5,229,817 A * 7/1993 Lange et al. ..... 399/34
5,600,405 A * 2/1997 Umeda et al. ..... 399/71
6,219,505 B1 * 4/2001 Sato et al. ..... 399/98
6,304,735 B1 * 10/2001 Nishimura et al. ..... 399/98
6,505,019 B2 * 1/2003 Sato et al. ..... 399/98
6,708,009 B2 * 3/2004 Fuwazaki et al. ..... 399/98
6,847,796 B2 * 1/2005 Chigono et al. ..... 399/174
7,149,455 B2 * 12/2006 Hattori ..... 399/98
2003/0053821 A1 * 3/2003 Miyakawa et al. ..... 399/159
2003/0202811 A1 * 10/2003 Kamimura et al. ..... 399/53
2004/0170453 A1 * 9/2004 Ito et al. ..... 399/315
2005/0201774 A1 * 9/2005 Yamagata ..... 399/98

FOREIGN PATENT DOCUMENTS

JP 08146782 A * 6/1996
TW 563627 1/1992

* cited by examiner

*Primary Examiner*—Daniel J. Colilla
*Assistant Examiner*—'Wynn' Q. Ha

(57) ABSTRACT

A sheet feeder with electrostatic dust-collecting function includes a paper path, a feeding roller, a dust-collecting passageway, an electrostatic charge generator and a dust-collecting box. The feeding roller located on the paper path feeds a sheet through the paper path. The dust-collecting passageway has an inlet connected to the paper path and an outlet located opposite to the inlet. The electrostatic charge generator disposed at the outlet of the dust-collecting passageway generates electrostatic charges to attract dust coming from the sheet through the dust-collecting passageway and the paper path. The dust-collecting box for collecting the dust is disposed at the outlet of the dust-collecting passageway and has an adhesive layer for adhering the dust.

14 Claims, 2 Drawing Sheets

SHEET FEEDER WITH ELECTROSTATIC DUST-COLLECTING FUNCTION

BACKGROUND OF THE INVENTION

1. Field of the Invention

The invention relates to a sheet feeder with electrostatic dust-collecting function, and more particularly to a sheet feeder for attracting dust according to electrostatic charges generated by an electrostatic charge generator so as to remove the dust. The sheet feeder of the invention is suitable for various document processing devices, such as a scanner, a copier, a printer, a multi-function peripheral, and the like.

2. Description of the Related Art

Most of the conventional automatic document feeders, especially the automatic document feeders for scanners, do not have the dust-removing design. Although some feeders have the dust-collecting designs, the dust including paper flakes and particles is usually collected in a dust-collecting box. However, if the rotational speed of the roller increases, the dust collected in the dust-collecting box tend to be rolled up by an air stream and then go back to a paper path, such that the scan quality or the print quality is influenced. Such a condition tends to be easily caused as the sheet feeding speed is getting higher and higher. Alternatively, the paper flakes and particles in the dust-collecting box tend to go back to the paper path as the automatic document feeder is transported, and the scan or print quality is thus influenced.

Taiwan patent publication No. 563627 discloses a dust-removing device for a sheet feeder, in which the paper flakes or particles on the sheet are blown and sucked away using a blowing and sucking mechanism. Usually, the blowing and sucking mechanism cannot completely remove the paper flakes and the particles from the sheet, and the paper flakes and particles tend to attach to the roller after the sheet contacts the roller. So, this technology cannot remove the paper flakes or particles from the roller, and the paper flakes or particles tend to influence the processing quality. In addition, this technology needs a huge blowing and sucking mechanism and an air-filtering device. So, this prior art is not suitable for the miniaturized automatic document feeder.

U.S. Pat. No. 6,708,009 discloses a printing device capable of removing dust. The printing device includes a dust-collecting box for collecting the dust and a sponge for scratching the paper flakes and particles from the roller. However, the paper flakes and particles are separated from the paper path due to the gravity. The size of the dust-collecting box has to be increased if it is desired to prevent the paper flakes and the particles from being blown back to the paper path due to the air stream caused by the roller rotating at the high speed. Thus, it is disadvantageous to the development of the miniaturized scanning device or printing device.

SUMMARY OF THE INVENTION

It is therefore an object of the invention to provide a sheet feeder with electrostatic dust-collecting function, wherein an electrostatic charge generator generates electrostatic charges to attract dust in a paper path so as to eliminate the poor effect caused by the dust during scanning or printing.

To achieve the above-identified object, the invention provides a sheet feeder including a paper path, a feeding roller, a dust-collecting passageway, an electrostatic charge generator and a dust-collecting box. The feeding roller located on the paper path feeds a sheet through the paper path. The dust-collecting passageway has an inlet connected to the paper path and an outlet located opposite to the inlet. The electrostatic charge generator disposed at the outlet of the dust-collecting passageway generates electrostatic charges to attract dust of the sheet through the dust-collecting passageway and the paper path. The dust-collecting box for collecting the dust is disposed at the outlet of the dust-collecting passageway and has an adhesive layer for adhering the dust.

The sheet feeder may further include a dust-collecting box and a dust remover. The dust-collecting box connected to the outlet of the dust-collecting passageway collects the dust. The dust remover disposed adjacent to the electrostatic charge generator removes the dust attracted by the electrostatic charge generator.

Attracting the dust using the electrostatic charges can eliminate the dust in the paper path more effectively and avoid the poor influence caused by the dust.

DETAILED DESCRIPTION OF THE INVENTION

In view of the occurrence of spots caused by dust after scanning, the invention removes the dust from a paper path and attracts and collects the dust by electrostatic charges. The method of collecting the dust using the electrostatic charges can be achieved by matching two materials with different mechanical and electrical properties. The electrostatic charges generated after rubbing can attract the falling dust to the surface of the charged body.

Figure 1:
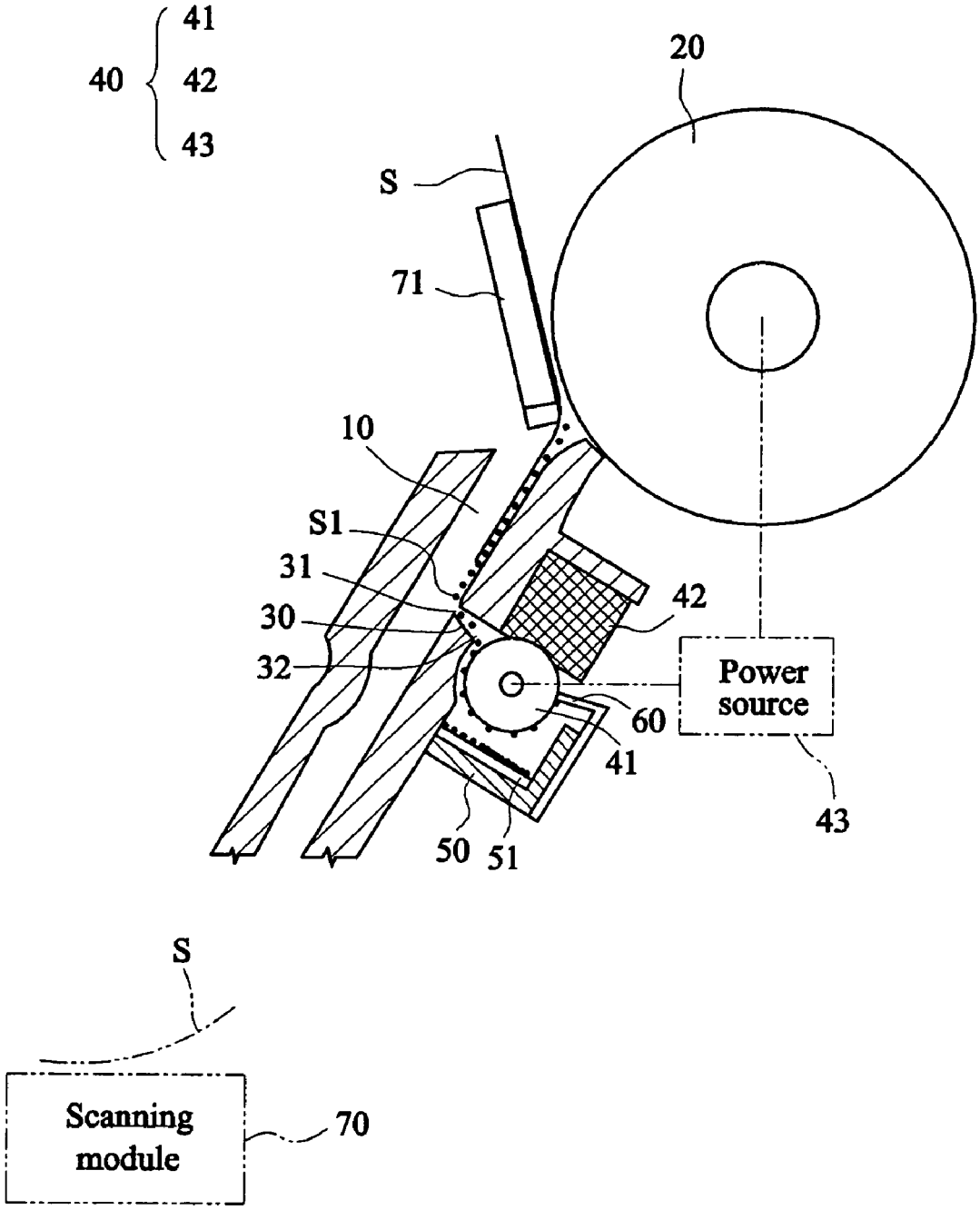
FIG. 1 is a schematic illustration showing a sheet feeder with electrostatic dust-collecting function according to a preferred embodiment of the invention.

FIG. 1 is a schematic illustration showing a sheet feeder with electrostatic dust-collecting function according to a preferred embodiment of the invention. Referring to FIG. 1, the sheet feeder with the electrostatic dust-collecting function according to this embodiment performs a document scanning operation in conjunction with a scanning module 70. Alternatively, the sheet feeder may also perform a printing operation in conjunction with a printing module. The sheet feeder includes a paper path 10, a feeding roller 20, a dust-collecting passageway 30, an electrostatic charge generator 40, a dust-collecting box 50 and a dust remover 60.

The feeding roller 20 located on the paper path 10 cooperates with a friction pad 71 to feed a sheet S through the paper pat 10. The dust-collecting passageway 30 has an inlet 31 connected to the paper path 10 and an outlet 32 located opposite to the inlet 31 and away from the paper path 10.

The electrostatic charge generator 40 disposed at the outlet 32 of the dust-collecting passageway 30 and in no direct contact with the feeding roller 20 and the sheet S generates electrostatic charges to attract dust S1 coming from the sheet S or the outside through the dust-collecting passageway 30 and the paper path 10. Also, the electrostatic charges attract the dust S1 of the sheet S in the paper path 10 into the dust-collecting passageway 30. The dust S1 includes paper flakes and particles. Specifically speaking, the electrostatic charge generator 40 includes a first part 41, a second part 42 and a power source 43. The first part 41 is disposed at the outlet 32 of the dust-collecting passageway 30. The second part 42 is in frictional contact with the first part 41. The power source 43 drives the first part 41 or the second part 42 to produce a relative movement between the first part 41 and the second part 42 so as to generate the electrostatic charges. That is, the first part 41 and the second part 42 may be rotated or moved relative to each other. In this embodiment, the feeding roller 20 is disposed at a level higher than a level of the dust-collecting passageway 30 so that the dust S1 of the sheet S tends to fall into the dust-collecting passageway 30 along the pacer path 10.

In this embodiment, the first part 41 is a rotatable part made of a polyester-like material. The power source 43 drives the rotatable part 41 to rotate. The second part 42 is made of a silk material. The materials of the first part 41 and the second part 42 may be chosen according to the demand of design, and detailed descriptions thereof will be omitted. If the electrostatic discharge interference is to be avoided, it is possible to choose the materials which generate smaller charges after rubbing.

The rotatable part 41 of the electrostatic charge generator 40 attracts the dust S1 and is located in the dust-collecting box 50. In order to reduce the number of power sources of the sheet feeder, the power source 43 may also drive the feeding roller 20 and the rotatable part 41 to rotate simultaneously.

The dust-collecting box 50 connected to and disposed at the outlet 32 of the dust-collecting passageway 30 collects the dust S1. The dust-collecting box 50 may have an adhesive layer 51 for adhering the dust S1 to prevent the dust S1 from flying.

The dust remover 60 may be a scraper or a brush disposed adjacent to the rotatable part 41 of die electrostatic charge generator 40. The dust remover 60 removes the dust S1 attracted by the electrostatic charge generator 40 so as to prevent too much dust from accumulating on the second part 42 and thus influencing the generation of the electrostatic charges.

Figure 2:
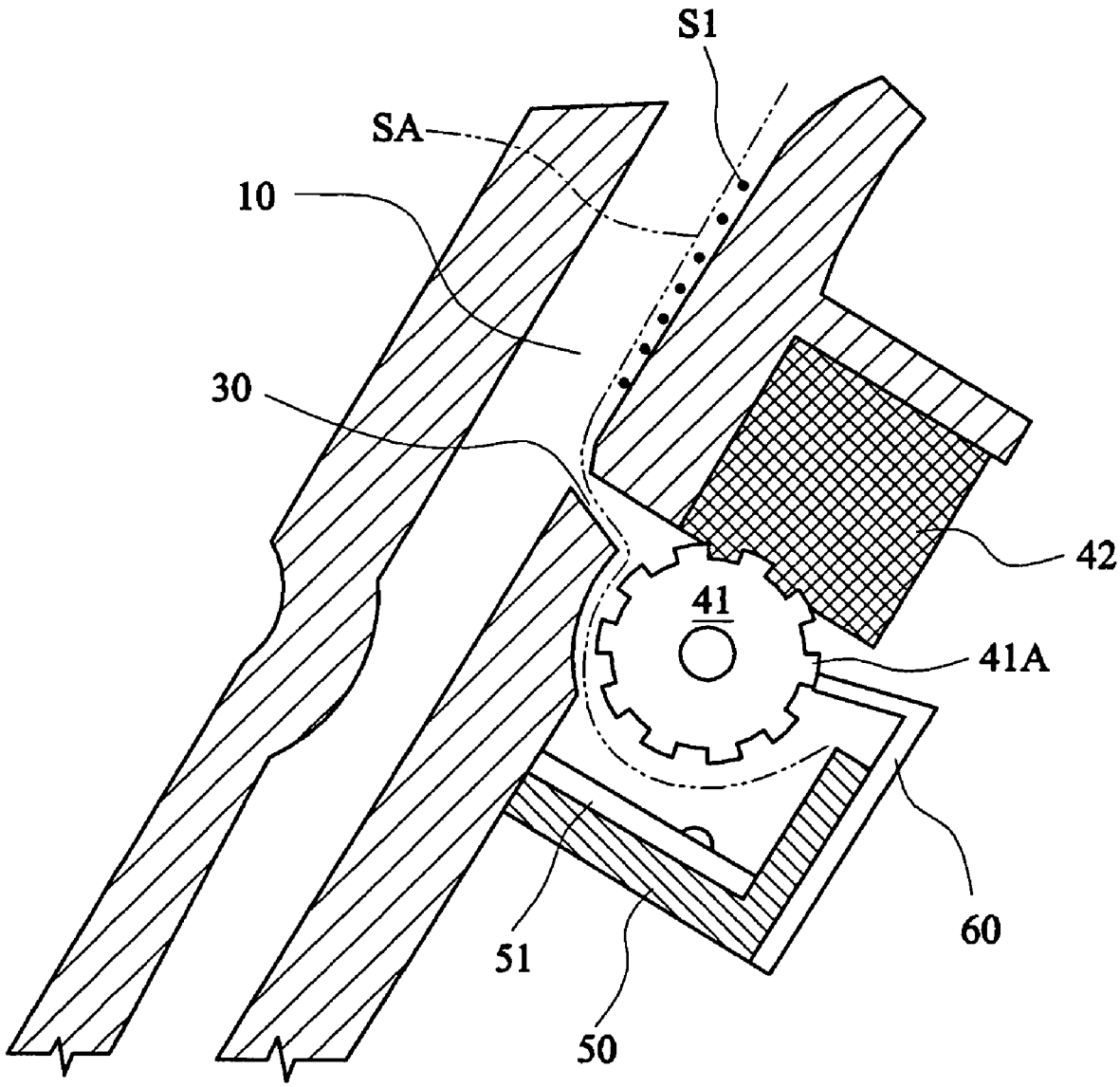
FIG. 2 shows an example of the rotatable part of FIG. 1.

The rotatable part 41 may be a roller with a circular outer circumference or a member with a non-circular outer circumference. FIG. 2 shows an example of the rotatable part of FIG. 1. Referring to FIG. 2, the rotatable part 41 has a sawtooth-like circumference 41A. The rotating rotatable part 41 generates the electrostatic charges after rubbing with the second part 42 and further generates an air stream SA, which comes from the paper path 10 into the dust-collecting passageway 30, through the sawtooth-like circumference 41A. The air stream SA can assist in guiding the dust S1 into the dust-collecting passageway 30. The dust can be effectively guided into the dust-collecting box 50 according to the electrostatic charges and the guiding air stream. In addition, the dust in the paper path may be removed more effectively with the aids of the dust remover and the adhesive layer. Thus, it is possible to prevent the dust from influencing the image processing operation such as scanning or printing.

For example, the charges on the paper flakes are usually positive, so the rotatable part 41 for attracting the paper flakes must have negative ones. After the sheet feeding operation ends, the negative charges of the rotatable part 41 attract the particles with the positive ones in the atmosphere such that the electrostatic charges on the rotatable part 41 gradually disappear. So, no serious electrostatic discharge interference will occur.

While the invention has been described by way of examples and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications.

What is claimed is:

1. A sheet feeder, comprising:

a paper path;

a feeding roller, which is located on the paper path, for feeding a sheet through the paper path;

a dust-collecting passageway having an inlet connected to the paper path and an outlet located away from the paper path;

an electrostatic charge generator, which is disposed at the outlet of the dust-collecting passageway and in no direct contact with the feeding roller and the sheet, for generating electrostatic charges to attract dust of the sheet in the paper path into the dust-collecting passageway; and a dust-collecting box, which is disposed at the outlet of the dust-collecting passageway, for collecting the dust, wherein the dust-collecting box has an adhesive layer for adhering the dust.

2. The sheet feeder according to claim 1, wherein the electrostatic charge generator is located in the dust-collecting box.

3. The sheet feeder according to claim 1, further comprising:

a dust remover, which is disposed adjacent to the electrostatic charge generator, for removing the dust attracted by the electrostatic charge generator.

4. A sheet feeder, comprising:

a paper path;

a feeding roller, which is located on the paper path, for feeding a sheet through the paper path;

a dust-collecting passageway having an inlet connected to the paper path and an outlet located away from the paper path; and an electrostatic charge generator, which is disposed at the outlet of the dust-collecting passageway and in no direct contact with the feeding roller and the sheet, for generating electrostatic charges to attract dust of the sheet in the paper path into the dust-collecting passageway, wherein the electrostatic charge generator comprises:

a first part disposed at the outlet of the dust-collecting passageway;

a second part in frictional contact with the first part; and a power source for driving the first part or the second part to produce a relative movement between the first part and the second part and thus to generate the electrostatic charges.

5. The sheet feeder according to claim 4, wherein the first part is a rotatable part, the power source drives the rotatable part to rotate, and the rotatable part attracts the dust.

6. The sheet feeder according to claim 5, wherein the rotatable part is made of a material, which generates negative charges after rubbing, and the second part is made of a material, which generates positive charges after rubbing.

7. The sheet feeder according to claim 6, wherein the rotatable part is made of a polyester-like material and the second part is made of a silk material.

8. The sheet feeder according to claim 5, further comprising:

a dust-collecting box, which is disposed at the outlet of the dust-collecting passageway, for collecting the dust.

9. The sheet feeder according to claim 8, wherein the rotatable part is located in the dust-collecting box.

10. The sheet feeder according to claim 8, wherein the dust-collecting box has an adhesive layer for adhering the dust.

11. The sheet feeder according to claim 5, further comprising:

a dust remover, which is disposed adjacent to the rotatable part, for removing the dust attracted by the rotatable part.

12. The sheet feeder according to claim 5, wherein the power source drives the feeding roller and the rotatable part to rotate simultaneously.

13. The sheet feeder according to claim 5, wherein the rotatable part has a sawtooth-like circumference for generating an air stream flowing from the paper path into the dust-collecting passageway so as to assist in guiding the dust into the dust-collecting passageway.

14. The sheet feeder according to claim 1, wherein the feeding roller is disposed at a level higher than a level of the dust-collecting passageway so that the dust of the sheet tends to fall into the dust-collecting passageway along the paper path.

* * * * *